United States Patent [19]

Kreusel

[11] Patent Number: 4,602,457

[45] Date of Patent: Jul. 29, 1986

[54] WINDOW FITTING FOR SINGLE HANDED SWINGING AND TILTING OF THE WINDOW

[76] Inventor: Ulrich Kreusel, Schlosstr. 14, 6531 Gensingen, Fed. Rep. of Germany

[21] Appl. No.: 640,329

[22] Filed: Aug. 13, 1984

[30] Foreign Application Priority Data

Aug. 13, 1983 [DE] Fed. Rep. of Germany ..... 3329414

[51] Int. Cl.[4] ..... E05D 15/52

[52] U.S. Cl. ..... 49/192

[58] Field of Search ..... 49/192

[56] References Cited

U.S. PATENT DOCUMENTS 3,866,355 2/1975 Jacob ..... 49/192

3,994,093 11/1976 Mayer et al. ..... 49/192

FOREIGN PATENT DOCUMENTS 0064595 3/1982 European Pat. Off. ..... 49/192

*Primary Examiner*—Kenneth Downey

*Attorney, Agent, or Firm*—Collard, Roe & Galgano

[57] ABSTRACT

There is provided a fitting for a window for single-handedly swinging and tilting such window, said fitting being arranged, with the exception of the operating handle provided with a position-arresting facility, concealed between the frame and casement of the window, with at least one lock facility consisting of a lock pin on the casement side as well as a lock plate on the frame side; a tilting facility associated with the bottom cross member of the window frame; a bottom hinge for swinging and tilting; and a swinging top hinge cooperating with a scissors-type lever system or linkage for tilting the window. The window fitting includes a flat belt revolving in the casement of the window in a guide channel with inserted corner turning facilities, the flat belt being rigidly connected with a driving lug for the operating handle, the lock pin of the lock facility, a lock element of the tilting facility and with a lock element of the scissors-type lever system for tilting the window.

8 Claims, 35 Drawing Figures

FIG. 2a
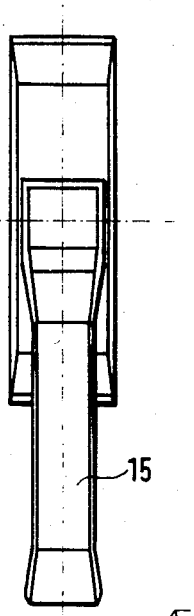
FIG. 2b
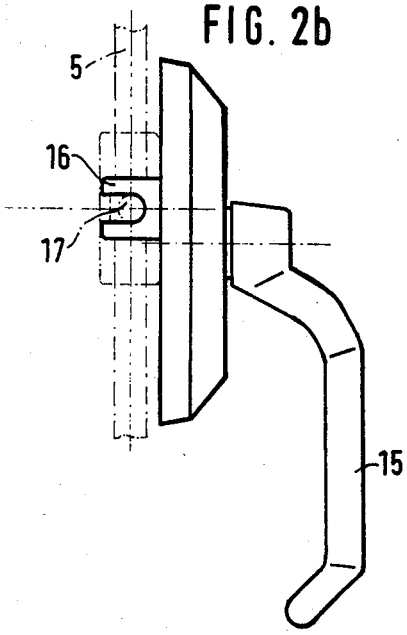
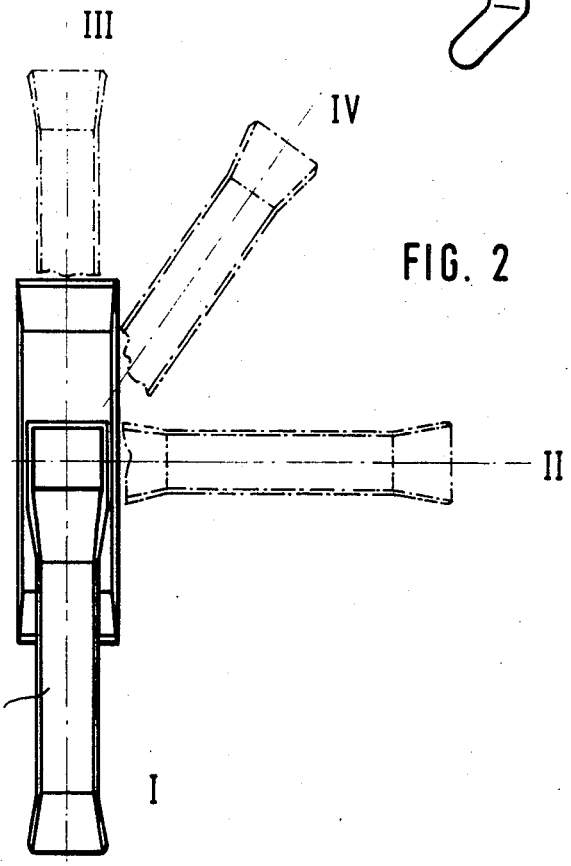
FIG. 2

IV

III

II

I

FIG. 6d
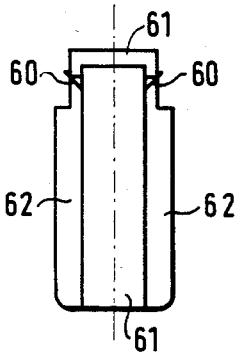
FIG. 6c
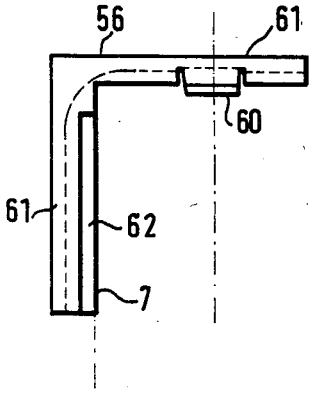
FIG. 6b
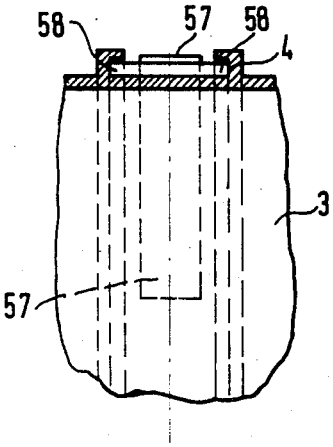
FIG. 6
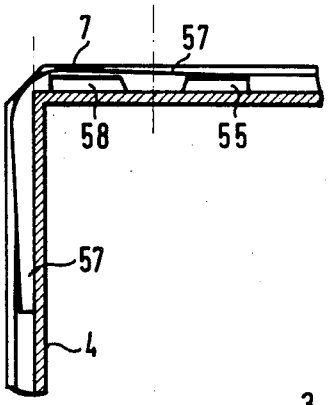
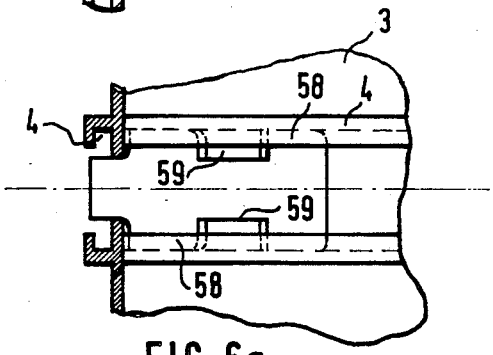
FIG. 6a

WINDOW FITTING FOR SINGLE HANDED SWINGING AND TILTING OF THE WINDOW

The present invention relates to a fitting for a window or the like for swinging and tilting such a window with one hand. With the exception of the operating handle, which is provided with a position locking facility, the window fitting is arranged to be concealed between the frame and casement or sash or the window, and comprises at least one locking facility consisting of a lock pin on the casement side and a lock plate on the frame side; a tilting facility associated with the bottom cross member of the frame; a bottom or lower hinge for swinging and tilting, and a top or upper rotary hinge cooperating with a scissor-type lever system for tilting the window outwardly.

It has long been known to support window casements on the wndow frame in a way such that the window can be both swung and tilted open and shut. When swung, the window is supported by the bottom hinge for swinging and tilting, which is arranged laterally, and the top rotary hinge. In the tilted position, the window is supported on the one hand by the swinging and tilting hinge as well as the tilting facility on the bottom cross piece of the window, and on the other hand by the scissor-type lever system, which cooperates with the top rotary hinge.

A window capable of being swung and tilted is disclosed in German utility Pat. No. DE-GM No. 6 938 096. Said known window comprises a window frame with corner bearings and a window casement supported by said bearings, with guide bores for lock bars or rods capable of being pushed into and pulled from said corner bearings with the help of a handle, and with a lock and fittings. With this known design, a rope is provided, which is displaceable in the casement in a guide bore extending around the window next to the guide bores for the closing or lock rods, namely with the help of the handle. With the help of the rope, the lock rods can be pushed into the corner bearings and pulled from said bearings. The displaceable lock rods are secured on the rope by means of dogs and the rope is guided at the corners of the window with the help of corner pulleys. Such a fitting, on the one hand, requires relatively long locking rods, and extra space for accommodating the corner pulleys, on the other hand.

The object of the present invention is to provide a fitting of the above described type for swinging and tilting a window by one hand, which fitting has an extremely simple design, which means it offers cost savings, which assures easy and quick fitting, and, furthermore, which operates in a highly reliable way.

According to the invention, this object is accomplished by a revolving flat belt running in the window casement in a guide channel provided with corner turning facilities. The flat belt is rigidly connected with a drive pin for the operating handle, the lock pin of the locking facility, a lock element of the tilting device and a lock element for the scissor-type lever system for tilting the window.

Due to its simple structure, this solution permits the realization of a window fitting for single-handed swinging and tilting of such window which can be manufactured at favorable costs. The required components are limid to a minimum. Furthermore, the steps required for fitting or mounting said single-hand swinging and tilting fitting are limited to a minimum. Moreover, by mounting all sliding components on the flat belt, a trouble-free operation is assured.

In order to compensate for changes in the length of the flat belt due to temperature changes or material stretching, the design according to the invention provides for connecting the free ends of the revolving belt with each other in the guide channel of the bottom cross member of the casement with the help of a spring-loaded screw clamp.

According to a refinement of the object of the invention, the lock pin of the lock facility is slideably guided in the guide channel of the window casement by way of an attachment forming one piece with said pin and having a break-through or opening serving as a passageway for the flat belt. The flat belt is fixed in its position between the spherical cap-shaped foot of a hexagonal socket-head bolt inserted in the lock pin and extending up to the opening in the attachment, and a recess provided in the attachment of the lock pin matching the foot of the hexagonal socket-head screw and being oppositely arranged therefrom. This assures a safe seat of the lock pin on the flat belt and prevents any damage to the flat belt due to the fastening of the lock pin thereon. As a result of the cooperation between the spherical cap-shaped foot of the hexagonal socket-head screw and the corresponding recess in the attachment of the lock pin, the flat belt is deformed within said zone only in a spherical cap-shaped way for fixing the lock pin on said flat belt, so that said belt is not weakened at that point. For the purpose of facilitating the insertion of the flat belt, the ends of the opening in the attachment of the lock pin are usefully provided with a conical shape.

According to a preferred embodiment of the present invention, the lock plate, which is rigidly fitted in a guide channel in the frame of the window, has two ramp-like run-up or limit areas for the lock pin, which areas or sections are separated by a center extension for right-side and left-side application. For the purpose of compensating tolerances in the guide channels, each of said ramp-like run-up areas or surfaces of the lock plate for the locking pin extends ascendingly towards the center extension of the lock plate, which assures that the lock pin is running up with full surface contact. Moreover, it is useful if each run-up surface of the lock plate for the lock pin extends ascendingly towards the bottom of the guide channel of the window frame, which permits controlling the contact pressure of the casement on the frame by way of the lock pin.

According to another design feature of the present invention, a lock element of the tilting facility on the casement side engages via a hook connection a tilting trestle rigidly mounted in the guide channel of the window frame whenever the casement is in the fully tilted or a partly tilted position. In order to exclude any displacement of the flat belt—which is connected with the locking element—when the casement is in the fully tilted position, the hook of the locking element is preferably associated with a cam engaging a corresponding recess in the hook of the tilting trestle when the window casement is in the fully tilted position.

For the purpose of achieving a simple and easily mountable corner-turning facility of the fitting according to the invention, each plastic corner-turning device consists of a basic body inserted in the guide channel of the casement having two arms for guiding the flat belt, as well as a cover clipped in said guide channel.

A swinging and tilting hinge that is particularly suitable for the window fitting according to the present invention consists of a bearing block, a hinge tang inserted in said bearing block by way of a pin formed on said tang, and an angular holding element secured on said hinge tang and capable of being inserted in the guide channel of the casement, said holding element serving at the same time as a cover for the basic body of the corner-turning device associated with this section.

In order to assure a simple and safe function of the scissor-type lever system for tilting the window, a further refinement of the present invention provides that the window-tilting lever of said scissor-type lever system has a lock pin which, in the partly tilted position of the casement, engages behind a projecting extension of the lock element connected with the flat belt, and, in the swinging as well as closed positions of the casement, in a center cutout of the lock element. Since the casement fitted in the frame of the window may be readjusted in its position, a further refinement of the invention provides that the guide rail of the scissor-like lever system inserted in the guide channel of the casement is connected to an adjusting device also fitting in the guide channel of the casement.

Furthermore, it is preferred that all slideable components of the fitting according to the invention have rounded edges and corners in order to assure a smooth operation of said components.

Other objects and features of the present invention will become apparent from the following detailed description considered in connection with the accompanying drawing. It is to be understood, however, that the drawing is designed as an illustration only and not as a definition of the limits of the inveion.

In the drawing wherein similar reference characters denote similar elements throughout the several views:

FIG. 2 is an elevational view of the operating handle of the window shown in FIG. 1, showing various positions indicated by dot-dashed lines;

FIG. 2*a* is a view of the operating handle shown in FIG. 2;

FIG. 2*b* is a side elevational view of the handle shown in FIG. 2*a;*

Figure 1:
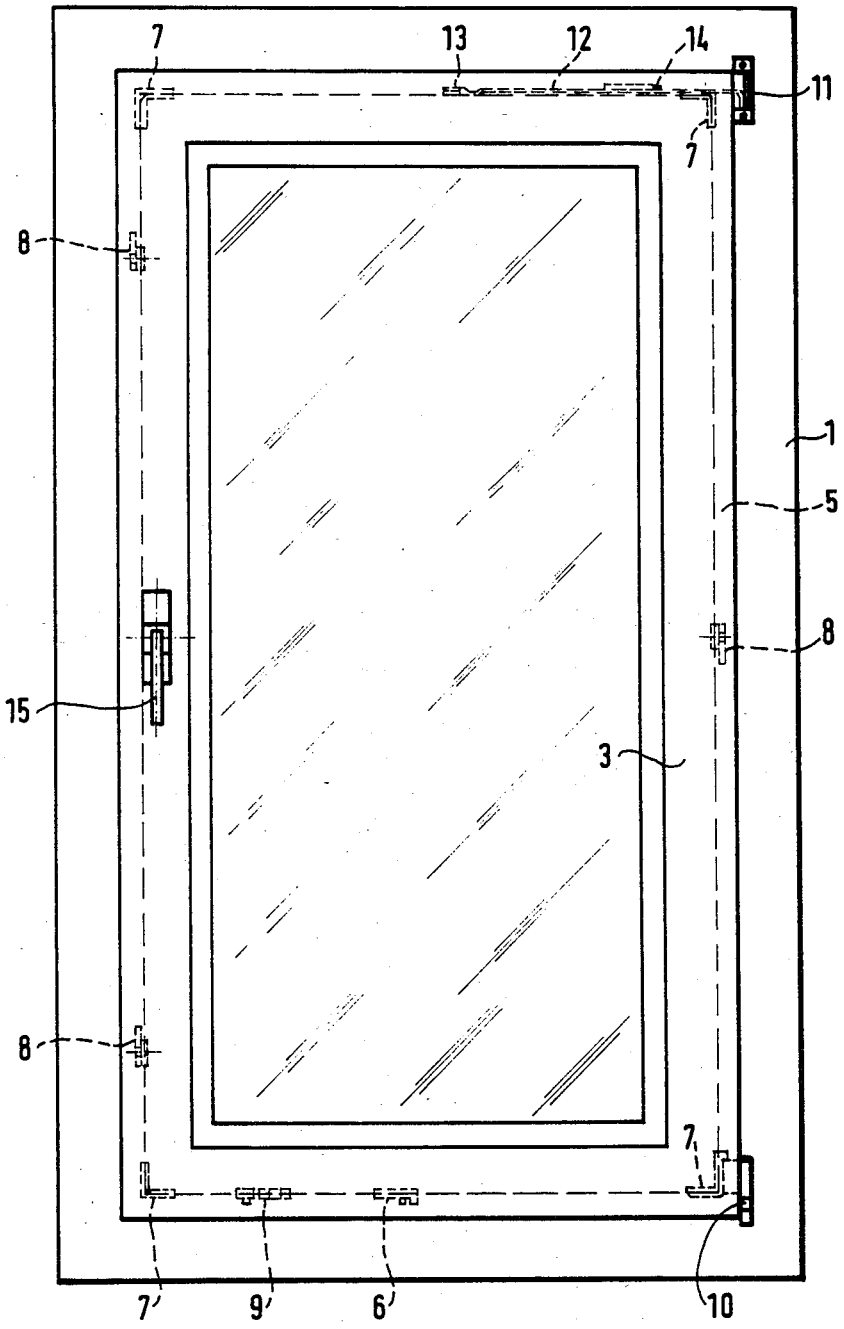
FIG. 1 is an elevational view of a rotatable and tiltable window equipped with the fitting according to the present invention.
Figure 3A:
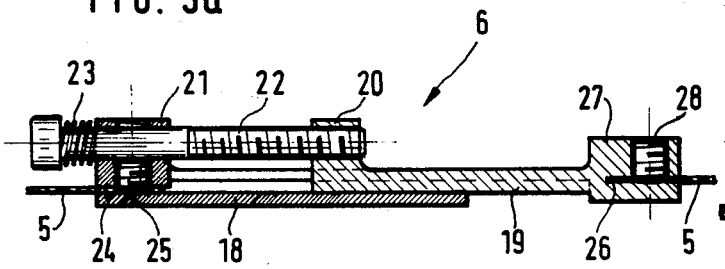
Figure 3B:
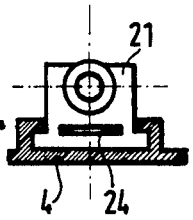
Figure 3:
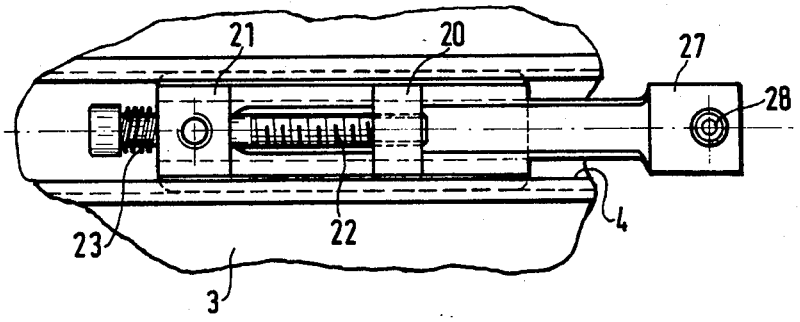

FIG. 3 is a plan view of the screw clamp for the flat belt of the fitting according to FIG. 1;

FIG. 3*a* is an elevational view in cross-section of the screw clamp according to FIG. 3;

FIG. 3*b* is a lateral view of the screw clamp according to FIG. 3*a;*

Figure 4B:
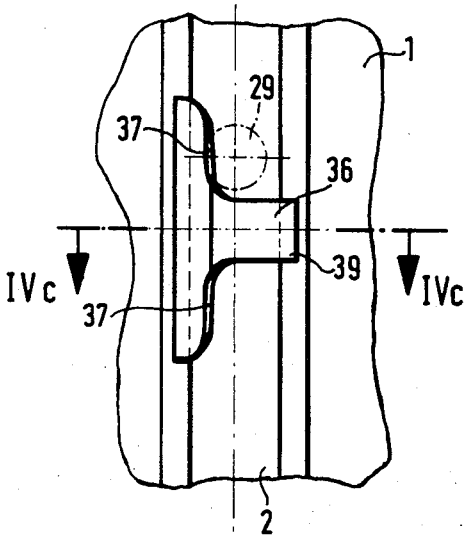
Figure 4:
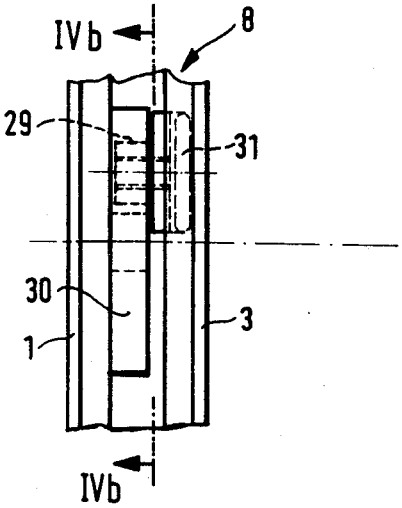
Figure 4C:
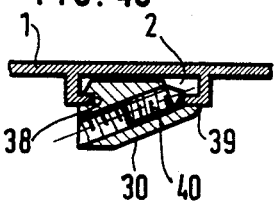
Figure 4A:
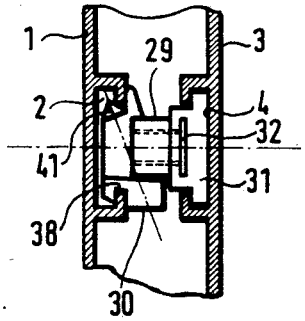

FIG. 4 is a detail drawing of one of the lock devices of the window fitting according to FIG. 1;

FIG. 4*a* is a top view of the lock device according to FIG. 4;

FIG. 4*b* is a cross-sectional view of the lock device according to FIG. 4 taken along line IVb—IVb of FIG. 4;

FIG. 4*c* is a sectional view of the locking device according to FIG. 4*b* along line IVc—IVc of FIG. 4*b;*

Figure 4D:
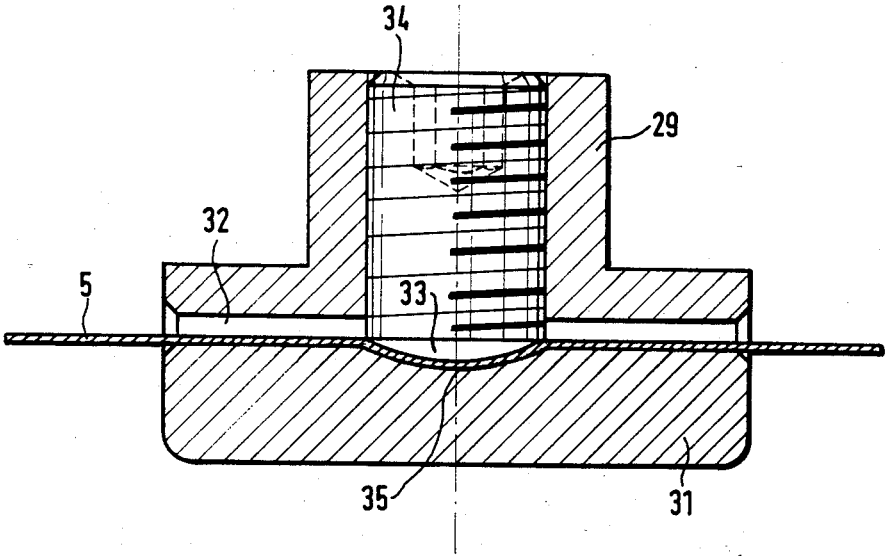
Figure 5A:
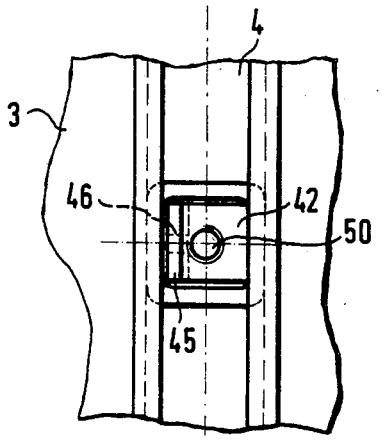
Figure 5:
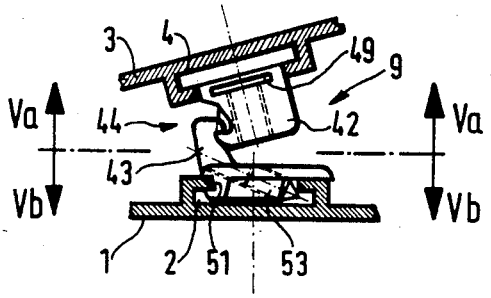
Figure 5B:
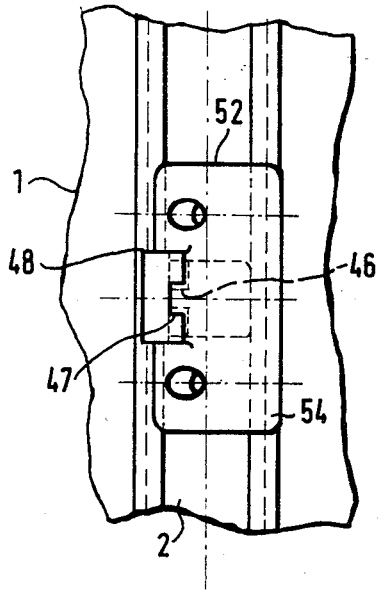
Figure 5C:
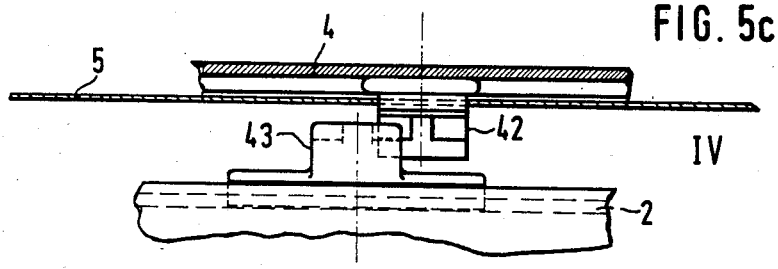
Figure 5D:
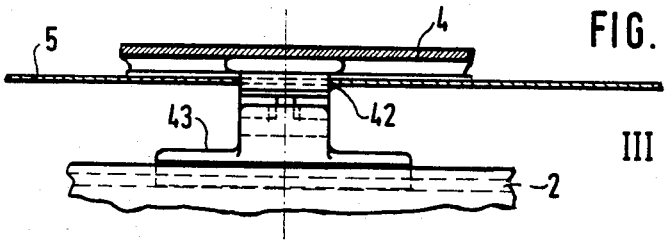
Figure 5E:
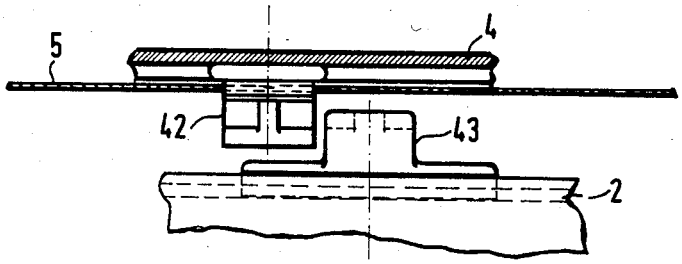
Figure 5F:
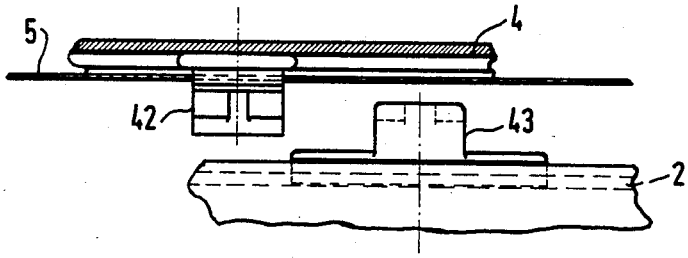

FIG. 4*d* is an enlarged cross-sectional view of the lock pin of the lock device according to FIG. 4;

FIG. 5 is a detail drawing of the tilting device of the window fitting according to FIG. 1;

FIG. 5*a* is a cross-sectional view of the tilting device according to FIG. 5 taken along line Va—Va;

FIG. 5*b* is a cross-sectional view of the tilting device according to FIG. 5 taken along line Vb—Vb;

FIG. 5*c* is an elevational view of the tilting device according to FIG. 5 with the window in a partially tilted position;

FIG. 5*d* is an elevational view of the tilting device according to FIG. 5 with the window in the fully tilted position;

FIG. 5*e* is an elevational view of the tilting device according to FIG. 5 with the window in the rotary or swinging position;

FIG. 5*f* is an elevational view of the tilting device according to FIG. 5 with the window in the closed position;

FIG. 6 is a detail drawing of one of the corner-turning devices of the window fitting according to FIG. 1;

FIG. 6*a* is a top view of the corner-turning device according to FIG. 6;

FIG. 6*b* is a lateral view of the corner-turning device according to FIG. 6;

FIG. 6*c* is a detailed view of the cover of the corner-turning device according to FIG. 6;

FIG. 6*d* is a side view of the cover according to FIG. 6*c;*

Figure 7:
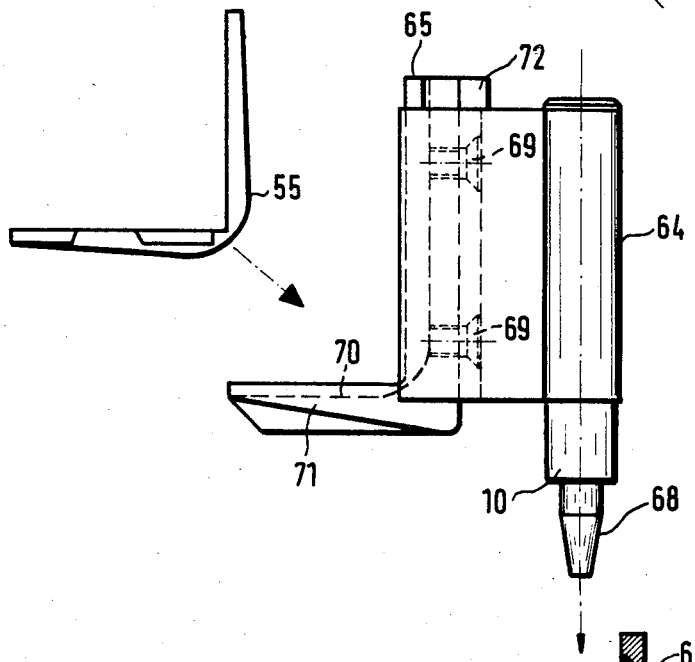
Figure 7A:
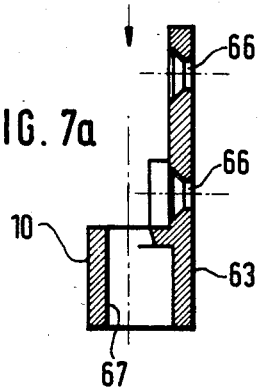
Figure 7C:
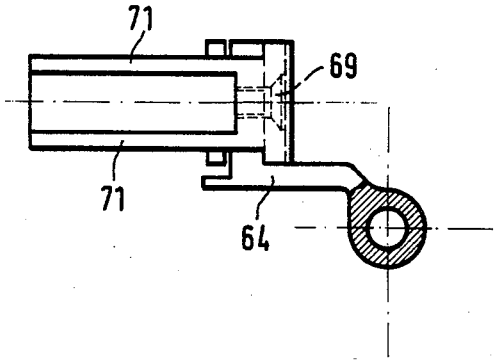
Figure 7B:
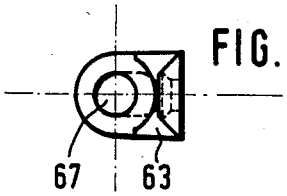

FIG. 7 is a detail drawing of the hinge tang on the casement side, with the holding element and associated basic body of the corer-turning device of the swinging-and-tilting hinge of the window fitting according to FIG. 1;

FIG. 7*a* is a detail drawing of the bearing block of the swinging-and-tilting hinge of the window fitting according to FIG. 1 on the side of the frame; to FIG. 7*b* is a top view on the bearing block according to FIG. 7*a;*

Figure 8:
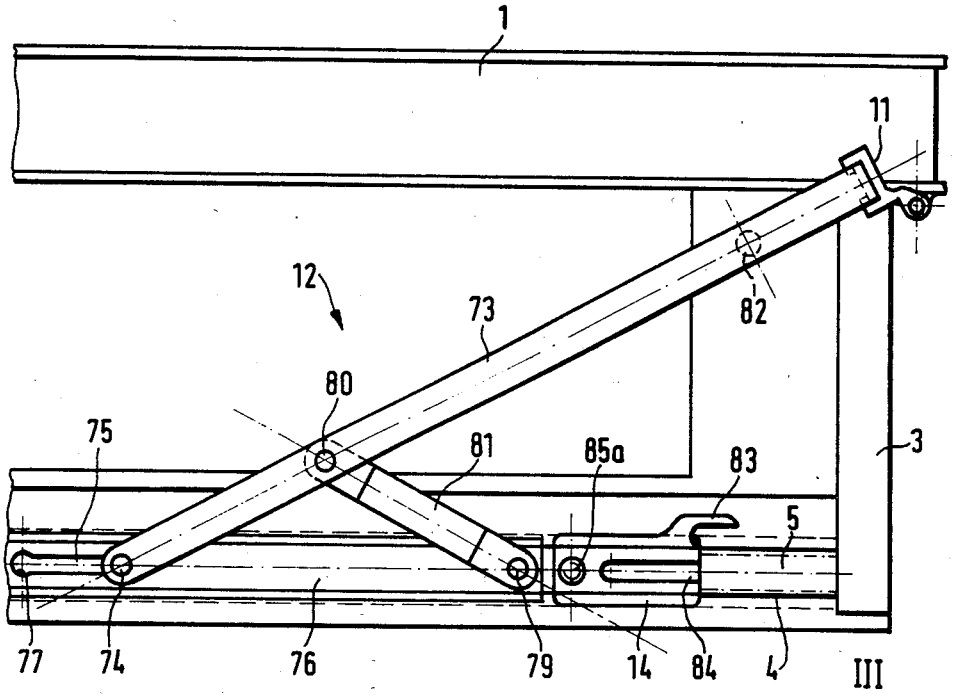
Figure 8A:
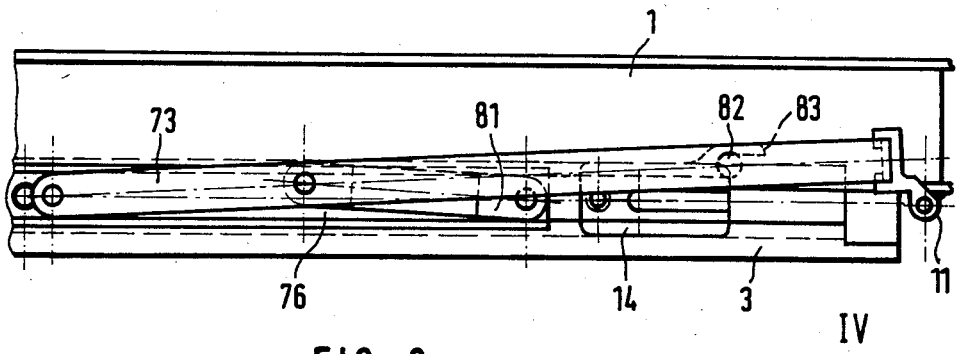
Figure 8B:
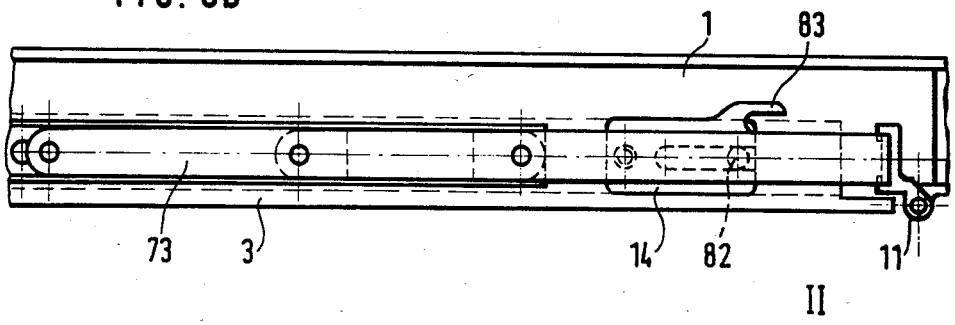
Figure 8C:
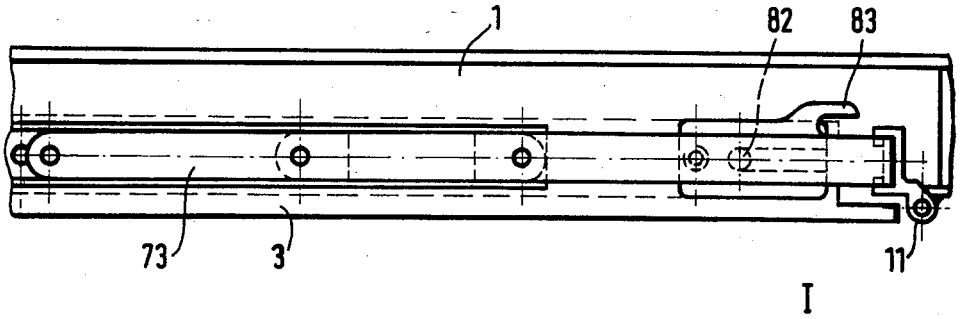
Figure 8F:
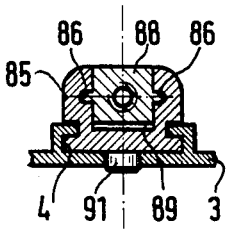
Figure 8E:
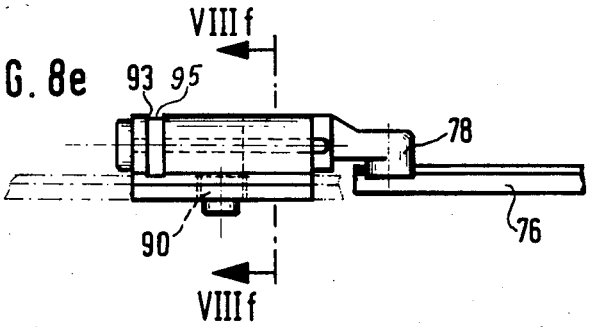
Figure 8D:
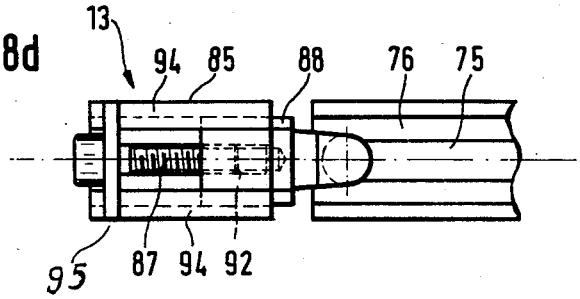

FIG. 7*c* is a top view of the hinge tang of the swinging-and-tilting hinge according to FIG. 7;

FIG. 8 is a top view of the scissor-type lever system of the window fitting according to FIG. 1, with the window in the fully tilted position;

FIG. 8*a* is a top view of the scissor-type lever system according to FIG. 8, with the window in a partially tilted position;

FIG. 8*b* is a top view of the scissor-type lever system according to FIG. 8, with the window in the swinging position;

FIG. 8*c* is a top view of the scissor-type lever system according to FIG. 8, with the window in the closed position;

FIG. 8*d* is a top view of the adjusting device of the window fitting according to FIG. 1 connected to the guide rail of the scissor-type lever system;

FIG. 8*e* is a side view of the adjusting device according to FIG. 8*d;* and FIG. 8*f* is a cross-sectional view of the adjusting device according to FIG. 8*e* taken along line VIIIf—VIIIf of FIG. 8*e.*

Now turning to the drawings, there is shown in FIG. 1 a window designed as a swinging and tilting window having a window frame 1 with an integrated guide channel 2 (see FIG. 4*a*) and a window casement 3 inserted in said frame. A guide channel 4 (see FIG. 4*a*) associated with casement 3 is arranged opposite guide channel 2 of frame 1. Window frame 1 and window casement 3 are preferably formed of hollow aluminum sections. Guide channel 4 of window casement 3 slideably accommodates a revolving flat belt 5 formed of metal, whose ends are kept together by means of a turnbuckle-like screw clamp 6. Lock devices 8 are associated at several points with belt 5, which is guided through special corner-turning devices 7. A tilting device 9 is arranged between the bottom cross member of window frame 1 and the bottom cross member of window casement 3. The bottom swinging-and-tilting hinge 10 and the top rotary hinge 11 are associated with casement 3. Rotary hinge 11 is pivotably connected with a scissor-type lever system 12 hinged on window casement 3. Lever system 12 is associated on the one side with an adjusting device 13 and on the other side with a lock element 14, said lock element being coupled with belt 5.

Belt 5 is displaced via an operating handle 15 positioned on the outer side of casement 3. The handle has a position lock device (not shown in the drawing) and, with its fork 16 arranged on the inside is slideably gripping around a drive pin 17 coupled with belt 5, as clearly seen in FIG. 2*b*.

If operating handle 15 is turned into its downward or bottom position in FIG. 2, window casement 3 is in the closed position I of FIG. 8*c*. If operating handle 15 is in its horizontal position, window casement 3 can be displaced into the swinging position II of FIG. 8*b*. If the handle is in its top position, casement 3 is in the fully tilted position III of FIG. 8, whereas if handle 15 is in the position between the rotary or swinging position II and the fully-tilted position III, casement 3 is in the partially-tilted position IV of FIG. 8*a*, which is also called the gap venting position.

As clearly seen in FIGS. 3 to 3*b*, screw clamp 6, which serves to adjust the length of belt 5 revolving in guide channel 4 of window casement 3, has a holding element 18 slideably inserted in guide channel 4 casement 3, with a connecting element 19 slideably inserted in the holding element. Connecting element 19 has an attachment 20 into which a lock screw 22 is screwed. The screw is guided through an attachment 21 of holding element 18. A compression spring 23 is arranged between attachment 21 of holding element 18 and the head of lock screw 22. An opening 24 in attachment 21 of holding element 18 permits the insertion of the one end of belt 5 into screw clamp 6. Said end of belt 5 is rigidly clamped by way of a hexagonal socket-head screw 25 screwed into attachment 21 of holding element 18 and disposed beneath lock screw 22. Socket head screw 25 has a spherical cap-shaped foot cooperating with a corresponding recess in holding element 18, which is arranged oppositely from said foot. The other end of belt 5 engages in an insertion slot 26 of an attachment 27 of connecting element 19 of screw clamp 6 and is fixed in position by a hexagonal socket-head screw 28 screwed into the attachment 27 and having a spherical cap-shaped foot cooperating with an opposing mating recess disposed in attachment 27. The spacing between attachment 20 of connecting element 19 and attachment 21 of holding element 18 is relatively large in order to avoid the need to provide exact measurements for the circumference of belt 5. With the help of the compression spring 23 of screw clamp 6, belt 5 is thus always taut.

As clearly seen in FIGS. 4 to 4*d*, lock device 8, of which the required number is associated with belt 5, consists of a lock pin 29 on the casement side and a lock plate 30 on the frame side. Lock pin 29 has an attachment 31 forming one piece with said pin and slideably guided in guide channel 4 of casement 3. Attachment 31 is provided with an opening or break-through 32 serving as a passageway for belt 5 the ends of which, as clearly seen in FIG. 4*d*, are provided with a conical shape in order to facilitate the insertion of belt 5. Belt 5 is clamped between spherical cap-shaped foot 33 of a hexagonal socket-head screw 34 screwed into lock pin 29 and extending into the opening provided in attachment 31, and a recess 35 provided in attachment 31 of lock pin 29. Recess 35 mates with and is disposed opposite said foot 33. Analogous to fastening of belt 5 on lock pin 29, which excludes damage to the belt, drive pin 17 for handle 15 is fitted on belt 5.

Lock plate 30 cooperating with lock pin 29 has two ramp-like run-up areas or surfaces 37 for the lock pin, which areas or surfaces are separated by a center extension 36 for left-side and right-side application. Each ramp-like run-up surface 37 of lock plate 30 extends ascendingly on the one side towards said center extension 36 and ascendingly on the other side towards the bottom of guide channel 2 of window frame 1. Lock plate 30 is retained in its position on the one hand by means of a through-extending recess 38 projecting across the one bridge or web of guide channel 2 of window frame 1, and on the other hand by a hexagonal socket-head screw 40 inserted above recess 38 and extending inclined to below extension 36 resting with its attachment 39 on the other, oppositely disposed bridge or web of guide channel 2 of frame 1, said hexagonal socket-head screw 40 having a tapered foot 41 supported on the bottom edge of the associated bevelled bridge or web of guide channel 2 of window frame 1. By securing the lock plate in this way, lock plate 30 is simultaneously fixed in the horizontal and vertical directions.

As seen in FIGS. 5 to 5*f*, tilting device 9 comprises a lock element 42 disposed on the casement side and a tilting trestle 43 arranged on the frame side. In the fully and partially tilted positions III and IV, respectively, said lock element 42 is engaged with said tilting trestle 43 by means of a hook connection 44. Hook 45 of lock element 42 is associated in the center with a cam 46, which, in the fully-tilted position III of casement 3, engages in a matching recess 47 in hook 48 of trestle 43. Lock element 42, which slidably guided in guide channel 4 of casement 3, has an opening 49 provided with conically shaped ends and serving as a passage for belt 5. Belt 5 is rigidly clamped in its position via a hexagonal socket-head screw 50 inserted in lock element 42 and extending into said opening 49 and having a spherical cap-shaped foot cooperating with a corresponding recess oppositely arranged from said foot in lock element 42. Tilting trestle 43 is secured on the one hand via the through-extending recess 51 provided in the base 52 of tilting trestle 43, said recess projecting across the one bevelled bridge or web of guide channel 2 of frame 1, and, on the other hand, by two hexagonal socket-head screws 53 inserted laterally from said hook 48 of tilting trestle 43 in the base of said trestle. The hexagonal socket-head screws 53 extend diagonally to below a through-extending shoulder of tilting trestle 43, said shoulder resting on the other bevelled bridge or web of the guide channel of window frame 2, and the feet of said screws 53 are supported on the bottom edge of the associated bridge of guide channel 2. Also in this case, tilting trestle 43 is simultaneously secured in the vertical and horizontal directions. FIGS. 5*c* to 5*f* show the position of lock element 42 with respect to tilting trestle 43 in the partially-tilted position IV, fully-tilted position III, rotary or swinging position II and closed position I of window casement 3.

As seen in FIGS. 6 to 6*d*, each corner-turning device 7 is made of plastic material and consists of a basic body 55 and an associated cover 56. Basic body 55 has two arms 57 for guiding flat belt 5, where only the one arm 57 is fitted with lateral guides 58 for engaging the bevelled bridges or webs of guide channel 4 of casement 3 from behind. The ramp-like run-up surfaces of arms 57 of basic body 55 for belt 5 extend ascendingly towards their rounded corner connection in order to reduce the area of friction of the flat belt. Lateral guides 58 of the one arm 57 of basic body 55 are provided with oppositely arranged recesses 59, through which the corresponding clip extensions 60 of the one arm 61 of cover 56 grip behind the bevelled bridges of guide channel 4 of window casement 3. Only the other arm 61 of cover 56 has lateral guides 62 for insertion in guide channel 4 of casing 3. For reducing the force of friction of the flat belt, the contact surfaces of arms 57 of the basic body 55 for the flat belt are provided with a metal coating.

In FIGS. 7 to 7*c* swinging-and-tilting hinge 10 is shown consisting of bearing block 63, hinge tang 64 and the holding element 65. Bearing block 63 is secured to frame 1 by two screws supported in the openings 66 and has a bore 67 for receiving a conical pin 68 formed on hinge tang 64. Hinge tang 64 is connected with holding element 65 by screws 69, which extend only up to the inside 70 of holding element 65. Holding element 65, which is bevelled and inserted in guide channel 4 of casement 3, serves at the same time as the cover for the basic body of the corner turning or reversing device 7 associated with this section. The horizontally extending arm of holding element 65 is provided with lateral supports 71 for the window casement, whereas the vertically extending arm of said holding element has a support 72 mounted at its top end and resting on the hinge tang 64, which relieves the screws 69.

In FIGS. 8 to 8*c*, there is shown rotary or swinging hinge 11 hinged on window frame 1 supporting lever 73 of the scissor-type lever system 12 for tilting the window. The free end of lever 73 is provided with guide bolt 74, which projects into an elongated slot 75 of guide rail 76 of the scissor-type lever system. Guide rail 76 is inserted in guide channel 4 of window casement 3. The length of elongated slot 75 determines the angle of tilt of casement 3 in its fully-tilted position III in that guide bolt 74 is stopped by the end of elongated slot 75 on the hinge side. The other end of elongated slot 75 is provided with an expanded clearance 77, in which a pin 78 of adjusting device 13 (FIGS. 8*d* to 8*f*), which is mounted in guide channel 4, engages. A pivot pin 79 is arranged at the end of guide rail 76 opposing elongated slot 75. Pivot pin 79 supports a guide rod 81 which, by way of a pivot pin 80, is connected with lever 73 for tilting the window outwardly. Between pivot pin 80 and rotary hinge 11, a lock pin 82 is eccentrically supported on lever 73. In the partially tilted position IV of casement 3, lock pin 82 engages behind a projecting extension 83 of lock element 14, which is connected with belt 5. When the casement is in the swinging position II or the closed position I, said pin 82 engages in the center notch or cut 84 of lock element 14. Lock element 14 which is guided in guide channel 4 of casement 3 is provided with an opening for passing through flat belt 5. Said flat belt 5 is solidly clamped between the spherical cap-shaped foot of a hexagonal socket-head screw inserted in the top side of locking element 14 and extending into said opening, and a recess in lock element 14, which recess matches the foot of hexagonal socket-head screw 85*a* and is opposite said foot.

Adjusting device 13, as seen in FIGS. 8*d* to 8*f*, consists of a basic body 85 secured in guide channel 4 of casement 3 and a pusher 88, which is slideably guided in basic body 85 by means of guides 86 and fixed in its position by a screw 87. Pin 78 of the pusher, which is formed on the pusher, engages in recess 77 of elongated slot 75 of guide rail 76. Flat belt 5 is passed through adjusting device 13 by way of a corresponding gap 89 between pusher 88 and body 85. Body 85 of adjusting device 13 is secured in the guide channel 4 of window casement 3 by a set screw 90 inserted in the bottom of body 85. Pin 91 of the set screw, which is inserted in a corresponding bore of guide channel 4, has a diameter smaller than the diameter of set screw 90. Screw 87, which is screwed in a threaded oblong bore 92 of pusher 88, is supported at its head on a plate 95, which is loosely inserted in matching recesses 93 of side walls 94 of body 85 and has a bore therethrough for the shaft of the screw. Thus, the position of window casing 3 can be adjusted by turning screw 87.

While only a single embodiment of the present invention has been shown and described, it will be obvious that many changes and modifications may be made thereunto without departing from the spirit and scope of the invention.

What is claimed is:

1. A fitting for a window having a casement and a frame for the single-handed swinging and tilting of such window, said fitting being arranged, with the exception of an operating handle provided with a position locking facility, concealed between the frame and casement of the window, comprising at least one lock facility consisting of a lock pin on the casement side and a lock plate on the frame side, a tilting facility including a lock element associated with the bottom cross member of the window frame; a bottom hinge for swinging and tilting; and a top hinge for swinging cooperating with a scissors-type lever system including a lock element for tilting the window, the improvement comprising:

a flat belt having connected free ends and revolving in the casement of the window in a guide channel having inserted corner-turning means, said belt being rigidly connected with a drive lug for the operating handle, the lock pin of the lock facility, a locking element of the tilting facility, and with a lock element for the scissors-type lever system for tilting the window open, the free ends of the revolving flat belt being connected with each other in the guide channel of the bottom cross member of the window casement by a spring-loaded screw clamp consisting of a holding element slidably inserted in the guide channel of the window casement for one end of the flat belt, and a connecting element slidably guided in said holding element for the other end of the flat belt, with a lock screw guided through a first attachment of the holding element engaging a second attachment of the connecting element, said second attachment being arranged opposite said first attachment of the holding element, and with a compression spring provided between the first attachment of the holding element and the head of the lock screw.

2. The fitting as defined in claim 1, wherein the lock pin of the lock facility is slideably guided in the guide channel of the casement by an attachment which forms one piece with said pin and having an opening for passage therethrough of the flat belt, said flat belt being fixedly positioned between the spherical cap-shaped foot of a hexagonal socket-head bolt screwed into the lock pin extending up to said opening in said attachment, and a recess in the attachment matching the foot of the hexagonal socket-head screw and disposed opposite said foot.

3. The fitting as defined in claim 1, wherein a lock element of the tilting facility on the casement side, in the fully and partly tilted positions of the casement, engages by means of a hook connection a tilting trestle rigidly mounted in the guide channel of the window frame.

4. The fitting as defined in claim 1, wherein each corner-turning facility comprises a basic body mounted in the guide channel of the casement, having two arms for guiding the flat belt, and a cover clipped in the guide channel, said corner-turning facility being formed of plastic.

5. The fitting as defined in claim 1, wherein the hinge for swinging and tilting comprises a bearing block secured on the window frame, a hinge tang inserted in the bearing block by means of a pin formed on the hinge, and a bevelled holding element secured on the hinge tang and mounted in the guide channel of the casement and simultaneously serving as the cover for the basic body of the corner-turning facility.

6. The fitting as defined in claim 1, wherein the scissors-type lever system includes a lever having a lock pin which, in the partially tilted position of the window casement, engages behind a projecting extension of the lock element, and, in the rotating or swinging as well as closed positions of the casement in a center cut provided in the lock element.

7. The fitting as defined in claim 1, wherein the scissor-type lever system includes a guide rail mounted in the guide channel of the window casement and an adjusting facility mounted in the guide channel of the window casement connected to said guide rail.

8. A fitting for a window having a casement and a frame for the single-handed swinging and tilting of such window, said fitting being arranged, with the exception of an operating handle provided with a position locking facility, concealed between the frame and casement of the window, comprising at least one lock facility consisting of a lock pin on the casement side and a lock plate on the frame side, a tilting facility including a lock element associated with the bottom cross member of the window frame; a bottom hinge for swinging and tilting; and a top hinge for swinging cooperating with a scissors-type lever system including a lock element for tilting the window the improvement comprising:

an endless flat belt revolving in the casement of the window in a guide channel having inserted corner-turning means, said belt being rigidly connected with a drive lug for the operating handle, the lock pin of the lock facility, a locking element of the tilting facility, and with a lock element for the scissors-type lever system for tilting the window open, said lock plate of the lock facility being retained in its position on one side by a through-extending recess engaging one bevelled bridge of the guide channel of the frame, and on the other side by a hexagonal socket-head screw inserted above said recess and extending inclined across said plate to beneath the other bevelled bridge of the guide channel of the frame, said screw having a tapered foot supported on the bottom edge of the associated angular bridge of the guide channel of the window frame and engaging said bridge between said foot of said screw and an attachment of said lock plate.

* * * * *